US007180826B2

(12) United States Patent
Kusko et al.

(10) Patent No.: US 7,180,826 B2
(45) Date of Patent: Feb. 20, 2007

(54) MEASUREMENT WHILE DRILLING BI-DIRECTIONAL PULSER OPERATING IN A NEAR LAMINAR ANNULAR FLOW CHANNEL

(75) Inventors: David Kusko, Houston, TX (US); Peter Masak, deceased, late of West Chester, PA (US); by Adrienne D. Masak-Rozier, legal representative, West Chester, PA (US)

(73) Assignee: Teledrill Inc.

( * ) Notice: Subject to any disclaimer, the term of this patent is extended or adjusted under 35 U.S.C. 154(b) by 194 days.

(21) Appl. No.: 10/956,708

(22) Filed: Oct. 1, 2004

(65) Prior Publication Data

US 2006/0072374 A1 Apr. 6, 2006

(51) Int. Cl.
*H04H 9/00* (2006.01)

(52) U.S. Cl. ..... 367/85; 340/854.3; 175/45

(58) Field of Classification Search ..... 367/83, 367/85; 175/45; 340/854.3; 324/303
See application file for complete search history.

(56) References Cited

U.S. PATENT DOCUMENTS

| | | | |
|---|---|---|---|
| 4,742,498 | A | 5/1988 | Barron |
| 4,869,100 | A | 9/1989 | Birdwell |
| 4,901,290 | A | 2/1990 | Feld |
| 5,040,155 | A | 8/1991 | Feld |
| 5,103,430 | A | 4/1992 | Jeter |
| 5,117,398 | A | 5/1992 | Jeter |
| 5,134,285 | A | 7/1992 | Perry |
| 5,250,806 | A | 10/1993 | Reihn-Knudsen |
| 5,402,068 | A | 3/1995 | Meador |
| 5,461,230 | A | 10/1995 | Winemiller |
| 5,467,832 | A | 11/1995 | Orban |
| 5,473,579 | A | 12/1995 | Jeter |
| 5,517,464 | A | 5/1996 | Lerner |

(Continued)

FOREIGN PATENT DOCUMENTS

| | | | |
|---|---|---|---|
| EP | 0 681 090 | A2 | 11/1995 |

(Continued)

*Primary Examiner*—Albert K. Wong
(74) *Attorney, Agent, or Firm*—Guerry L. Grune

(57) ABSTRACT

A device, method, and system for creating a pressure pulse from drilling fluid within a drill string in a down hole drill collar for enabling measurement-while drilling. The device and system are designed such that primarily laminar flow exists in the area surrounding the pulser apparatus. The method associated with the reproducible and essentially noise-free pulses occurs when a pulser bell is manipulated in an upward and downward direction by a combination of the solenoid activation of a bi-directional poppet to redirect the fluid flow from the pressure reservoir to and from a sliding pressure chamber and associated upper and lower flow connecting channels. The pulse or non-pulse is converted into a digital signal uphole by a pressure transducer in conjunction with a decoding algorithm. It is then displayed to the driller and oilfield operators as useful directional and formation information that help the oilfield operator for uphole decision making regarding directional drilling. Additional pulsers can be added to the tool so that higher data bit rates can be accomplished. These higher data bit rates will provide for more comprehensive data collection thereby reducing drilling costs and optimizing oil field yields. The higher bit rate allows for more sensors that can send additional and improved information uphole without the use of open hole wire line logging which is impossible to accommodate while drilling horizontally.

45 Claims, 4 Drawing Sheets

U.S. PATENT DOCUMENTS

| | | | |
|---|---|---|---|
| 5,802,011 | A | 9/1998 | Winters |
| 5,804,820 | A | 9/1998 | Evans |
| 5,836,353 | A | 11/1998 | Van Steenwyk |
| 5,901,113 | A | 5/1999 | Masak |
| 6,002,643 | A | 12/1999 | Tchakarov |
| 6,016,288 | A | 1/2000 | Frith |
| 6,057,784 | A | 5/2000 | Scaaf |
| 6,094,401 | A | 7/2000 | Masak |
| 6,220,371 | B1 | 4/2001 | Sharma |
| 6,300,624 | B1 | 10/2001 | Yoo |
| 6,469,637 | B1 | 10/2002 | Seyler |
| 6,583,621 | B2 | 6/2003 | Prammer |
| 6,659,200 | B1 | 12/2003 | Eppink |
| 6,714,138 | B1 | 3/2004 | Turner |
| 2004/0089475 | A1 | 5/2004 | Kruspe |

FOREIGN PATENT DOCUMENTS

| | | |
|---|---|---|
| EP | 0 781 422 B1 | 7/1997 |
| GB | 2 157 345 A | 10/1985 |
| GB | 2 328 459 A | 2/1999 |
| WO | WO 00/57211 | 9/2000 |
| WO | WO 2004/044369 A2 | 5/2004 |

MEASUREMENT WHILE DRILLING BI-DIRECTIONAL PULSER OPERATING IN A NEAR LAMINAR ANNULAR FLOW CHANNEL

BACKGROUND OF THE INVENTION

1. Field of Invention

The current invention includes an apparatus and a method for creating a pressure pulse within drilling fluid that is generated by selectively activating solenoids that initiate flow driven bi-directional pulses. Features of the device include operating a pulser bell within a specially designed annular flow channel designed to reduce turbulent flow of the drilling fluid in a measurement-while-drilling device to provide for reproducible pressure pulses that are translated into relatively noise-free signals. The pulse is then received "up hole" as a series of signals that represent pressure variations which may be interpreted as gamma ray counts per second, azimuth, etc. by oilfield engineers and managers to recognize how to increase yield in oilfield operations.

Current purser technology includes pursers that are sensitive to different fluid pump down hole pressures, and flow rates, and require field adjustments to pulse properly so that meaningful signals from these pulses can be received by a programmable controller.

Additional advantages of the present invention are that it remains insensitive to fluid flow rate or pressure, does not require field adjustment, and is capable of creating recognizable, repeatable, reproducible, clean (i.e. noise free) fluid pulse signals using minimum power due to a unique pulser bell and lower inner flow channel design thereby also eliminating the need for drilling preparation, a field engineer at the well site continuously, and downtime expenses. The annular flow channel is specifically designed such that primarily laminar flow exists in the area where the pulse occurs, thereby providing frequent essentially noise-free pulses and subsequent noise-free signals. Additional pulsers with varying pressure amplitudes are easily added to enable an exponential increase in the bit rate that is sent uphole. This will also allow the addition of more downhole sensors without losing formation resolution.

2. Description of Prior Art

The present invention discloses a novel device for creating pulses in drilling fluid media flowing through a drill string. Devices currently in use require springs or solenoids to assist in creating pulses and are primarily located in the main drilling fluid flow channel. Current devices also require onsite adjustment of the pulser according to the flow volume and fluid pressure and require higher energy consumption due to resistance of the fluid flow as it flows downward in the drill collar. The present inventive apparatus and assembly is also supported by a rigid centralizer facing the direction of fluid flow. The centralizer provides support for the assembly. The pulser assembly includes a fishing head and fluid screen assembly attachment at the top end facing the flow.

The device provided by the current invention allows for the use of a pulser bell that moves from an initial position to an intermediate and final position in both the upward and downward direction corresponding to the direction of the fluid flow. The present invention avoids the use of springs, the use of which are described in the following patents which are also herewith incorporated by reference in U.S. Pat. Nos. 3,958,217, 4,901,290, and 5,040,155. The present invention uses at least two solenoids and simple connecting channels in specific angular positions to provide for enhanced pressure pulses. The design of the present invention allows for a smaller overall annular flow channel thereby allowing for laminar-like flow which also provides for a higher sampling (bit) rate, improved data analysis, less energy consumption and greater reliability.

U.S. Pat. No. 5,040,155 to Feld, et. al. describe a double guided fluid pulse valve that is placed within a tube casing making the valve independent of movement of the main valve body and free of fluctuations of the main valve body. The valve contains a pressure chamber with upwardly angled passages for fluid flow between the pressure chamber and the main valve body. Double guides ensure valve reliability in the horizontal position.

U.S. Pat. No. 5,473,579 to Jeter, et. al., describes a pulser that utilizes a servo valve and spring acting upon each other to urge a signal valve to move axially within a bore with signal assistance coming from a counter balance compensator device.

U.S. Pat. No. 5,117,398 to Jeter describes a pulser device that uses electromagnetically opened latches that mechanically hold the valve in the closed or open position, not allowing movement, until a signal is received and the latches are electronically released.

U.S. Pat. No. 6,002,643 by Tchakarov, et al., describes a pulser device in which a bi-directional solenoid contains a first and second coil and a rod extending within the coils used to actuate a poppet valve creating bi-directional pressure pulses. Orifices to permit the flow of drilling fluid to be acted upon by the piston assembly within the main body of the pulser tool and a pressure actuated switch to enable the electronics of the control device to act upon the pulser tool.

U.S. Pat. No. 4,742,498 to Barron describes a pulser device that has the piston that is acted upon by the drilling fluid and is allowed seating and unseating movement by use of springs and an omni directional solenoid.

U.S. Pat. No. 6,016,288 to Frith discloses a servo driven pulser which actuates a screw shaft which turns and provides linear motion of the valve assembly. All components except the shaft are within a sealed compartment and do not come in contact with the drilling fluid.

U.S. Pat. No. 5,802,011 to Winters, et al., that describes a solenoid driven device that pivots a valve that enters and leaves the annular drilling fluid flow blocking and unblocking the fluid flow intermittently.

U.S. Pat. No. 5,103,430 to Jeter, et al., describes a two chamber pulse generating device that creates fluid chambers above and below a poppet valve that is servo driven. Pressure differential is detected on either side of the poppet through a third chamber and the servo is urged to move the poppet in order to stabilize the pressure differential.

U.S. Pat. No. 5,901,113 to Masak, et al., describes a measurement while drilling tool that utilizes inverse seismic profiling for identifying geologic formations. A seismic signal generator is placed near the drill bit and the generated known signals are acted upon by the geologic formations and then read by a receiver array.

U.S. Pat. No. 6,583,621 B2 to Prammer, et al., describes a magnetic resonance imaging device comprising of a permanent magnet set within a drill string that generates a magnetic flux to a sending antennae that is interpreted up hole.

U.S. Pat. No. 5,517,464 to Lerner, et al., describes a pulse generating device utilizing a flow driven turbine and modulator rotor that when rotated creates pressure pulses.

U.S. Pat. No. 5,467,832 to Orban, et al., describes a method for generating directional downhole electromagnetic or sonic vibrations that can be read up hole utilizing generated pressure pulses.

U.S. Pat. No. 5,461,230 to Winemiller, describes a method and apparatus for providing temperature compensation in gamma radiation detectors in measurement while drilling devices.

U.S. Pat. No. 5,402,068 to Meador, et. al., describes a signal generating device that is successively energized to generate a known electromagnetic signal which is acted upon by the surrounding environment. Changes to the known signal are interpreted as geological information and acted upon accordingly.

U.S. Pat. No. 5,250,806 to Rhein-Knudsen, et al., describes a device wherein the gamma radiation detectors are placed on the outside of the MWD device to physically locate them nearer to the drill collar in order to minimize signal distortion.

U.S. Pat. No. 5,804,820 to Evans, et al., describes a high energy neutron accelerator used to irradiate surrounding formations that can be read by gamma radiation detectors and processed through various statistical methods for interpretation.

U.S. Pat. No. 6,057,784 to Schaaf, et al., describes a measurement while drilling module that can be placed between the drill motor and the drill bit situating the device closer to the drill bit to provide more accurate geological information.

U.S. Pat. No. 6,220,371 B1 to Sharma, et al., describes a downhole sensor array that systematically samples material (fluid) in the drill collar and stores the information electronically for later retrieval and interpretation. This information may be transmitted in real time via telemetry or other means of communication.

U.S. Pat. No. 6,300,624 B1 to Yoo, et al., describes a stationary detection tool that provides azimuth data, via radiation detection, regarding the location of the tool.

U.S. Pat. No. 5,134,285 to Perry, et al., describes a measurement while drilling tool that incorporates specific longitudinally aligned gamma ray detectors and a gamma ray source.

U.S. Application No. 2004/0089475 A1 to Kruspe, et. al., describes a measurement while drilling device that is hollow in the center allowing for the drilling shaft to rotate within while being secured to the drill collar. The decoupling of the device from the drill shaft provides for a minimal vibration location for improved sensing.

U.S. Pat. No. 6,714,138 B1 to Turner, et. al., describes a pulse generating device which incorporates the use of rotor vanes sequentially moved so that the flow of the drilling fluid is restricted so as to generate pressure pulses of known amplitude and duration.

G.B. Application No.2157345 A to Scott, describes a mud pulse telemetry tool which utilizes a solenoid to reciprocally move a needle valve to restrict the flow of drilling fluid in a drill collar generating a pressure pulse.

International Application Number WO 2004/044369 A2 to Chemali, et. al., describes a method of determining the presence of oil and water in various concentrations and adjusting drilling direction to constantly maintain the desired oil and water content in the drill string by use of measuring fluid pressure. The fluid pressure baseline is established and the desired pressure value is calculated, measured and monitored.

International Publication Number WO 00/57211 to Schultz, et. al., describes a gamma ray detection method incorporating the use of four gamma ray sondes to detect gamma rays from four distinct areas surrounding a bore hole.

European Patent Application Publication Number 0 681 090 A2 to Lerner, et. al., describes a turbine and rotor capable of restricting and unrestricting the fluid flow in a bore hole thereby generating pressure pulses.

European Patent Specification Publication Number EP 0 781 422 B1 to Loomis, et. al. describes utilizing a three neutron accelerator and three detectors sensitive to specific elements and recording device to capture the information from the three detectors.

SUMMARY OF INVENTION

The present invention discloses the placement of a pulser device including a pulser bell within an annular drill collar. The pulser design provides essentially four outer flow channels that allow fluid to flow. These are defined as the upper annular, the middle annular, lower annular, and centralizer annular collar flow channels. The inner lower and inner middle flow channels direct the fluid flow to the pulser bell apparatus within the measurement-while-drilling (MWD) device. Restricted annular fluid flow by the flow guide and pulser bell is essentially laminar and permits pulse signals that are more detectable, minimize the direct annular flow volume and change in pressure on the pulser device, and reduces energy consumption when compared with conventional devices.

Unique features of the pulser include the combination of middle and lower inner flow channels, pulser bell, poppet bellows, upper and lower flow connecting channels possessing an outlet angled opening and a dual solenoid system that creates signals in both the sealed and unsealed positions. Additional unique features include a flow guide for transitional flow and a sliding pressure chamber designed to allow for generation of the pressure pulses. The pulser bell slides axially on a pulser guide pole being pushed by the pressure generated in the pressure chamber when the poppet is in the seated position. Additional data (and increased bit rate) is generated by allowing the fluid to quickly back flow through the unique connecting channel openings when the poppet is in the unsealed position. Bi-directional axial movement of the pulser bell is generated by sequentially activating the push/pull solenoids. The signal generated provides at least twice the signal generation (bit rate) in comparison with conventional pulsers because of the bi-directional pulse feature. Cleaner signals are transmitted because the pulse is developed in near-laminar or completely laminar flow within the uniquely designed flow channels.

The method for generating pressure pulses in a drilling fluid flowing downward within a drill string includes starting at an initial first position wherein a bottom solenoid is activated such that a poppet (that can seat within a poppet seat which resides at the bottom of the middle inner flow channel) within a lower inner flow channel is not initially engaged. This allows for holding the poppet in this position with minimal current. The next step involves deactivation of the bottom solenoid and then a second top solenoid is activated, thereby moving the poppet into an engaged position. This motion seals a lower inner flow channel from the middle inner flow channel and forces the inner fluid into a pair of upper connecting flow channels, expanding the sliding pressure chamber, causing a pulser bell to move up toward a portion of a middle annular flow channel and stopping short of an orifice head, thereby causing a flow restriction. The flow restriction causes a pressure differential resulting in a pulse or pressure increase transmitted uphole. At the same time, fluid enters the exterior of the lower connecting flow channels, thus reducing the pressure drop across the poppet head seat. This allows for minimal force requirements for holding the poppet in the sealed position, thus saving a considerable amount of energy with respect to current designs. In the final position, the poppet moves back to the original or first position while allowing fluid to flow through a second set of lower connecting flow channels within the lower inner flow channel. This results in evacuating the sliding pressure chamber as fluid flows out of the chamber and back down the upper flow connecting channels into the middle inner flow channel and eventually into the lower inner flow channel. As this occurs, the pulser bell moves in a downward direction along the same direction as the flowing drilling fluid until motionless. This decreases the pulser bell-created pressure restriction of the main drilling fluid flow past the orifice head, resulting in a negative pulse.

DETAILED DESCRIPTION OF THE INVENTION

The present invention will now be described in greater detail and with reference to the accompanying drawing. With reference now to FIG. 1, the device illustrated produces pressure pulses in drilling fluid flowing through a tubular drill collar [29] and upper annular drill collar flow channel [2]. The flow guide [30] is secured to the inner diameter of the drill collar [29]. The centralizer [36] secures the lower portion of the pulse generating device and is comprised of a non-magnetic, rigid, wear resistant material with outer flow channels.

In the first (unsealed) position the poppet assembly [20] is not engaged within the poppet seat [19]. Energizing a bottom solenoid [33] pulls the actuator assembly [80] until it is flush with the bottom flux concentrator [35]. The solenoid actuator shaft [32], which is rigidly attached to the actuator assembly [80], moves to pull the poppet assembly [20] away from the poppet seat [19]. In the unsealed position, fluid flows past the fishing head [1] and mud screen assembly [3] where a portion of the fluid flows into the radially aligned slots [4] past the helical fluid screen [5] into the fluid screen assembly interior flow reservoir [6]. Fluid within the fluid screen assembly interior flow reservoir [6] flows into the transition [7] between the fluid screen reservoir and the middle inner flow channel [8] within the pulser guide pole [28].

Fluid flows past the upper flow connecting channels [25], sliding pressure chamber [26], and into the poppet seat [19] allowing the poppet assembly [20] to remain below the poppet seat [19]. This allows the fluid to flow into the lower inner flow channel [21], past the poppet bellows [22] and out of the lower flow connecting channels [23] into the lower annular drill collar flow channel [18]. Additionally, the fluid flows out of the constricting sliding pressure chamber [26] through the upper flow connecting channels [25] and past the poppet assembly [20] allowing the pulser bell [17] to move downward along the pulser guide pole [28] out of the throttle zone for pulse generation [14] thereby generating a negative pressure pulse and corresponding signal.

In the second (sealed) position the bottom solenoid [33] is de-energized and the top solenoid [31] is energized causing the actuator assembly [80] to be pushed until flush with the top flux concentrator [34]. The solenoid actuator shaft [32] then pushes the poppet assembly [20] until there is a seal with the poppet seat [19].

The lower inner flow channel [21] and the lower flow connecting channels [23] are effectively sealed so that fluid flow is completely restricted from above the poppet assembly [20]. As this sealing is achieved, fluid still enters the lower inner flow channel [21] via the lower connecting channel [23], thus almost equalizing the pressure across the poppet assembly [20]. The downward flow through the drill collar [29] causes the fluid to flow past the fishing head [1] and mud screen assembly [3] where a portion of the fluid flows into the radially aligned slots [4] past the helical fluid screen [5] into the fluid screen assembly interior flow reservoir [6]. The fluid next flows into the transition [7] between the fluid screen reservoir [6] and the middle inner flow channel [8]. Fluid then flows into the middle inner flow channel [8] through the upper flow connecting channels [25] and into the sliding pressure chamber [26] filling and expanding the sliding pressure chamber, causing the pulser bell [17] to rise along the pulser guide pole [28]. This effectively restricts the middle annular drill collar flow channel [12] from the lower annular drill collar flow channel [18], thereby generating a positive signal pulse at the throttle zone for pulse generation [14] and corresponding signal transmittal.

These conditions provide generation of a pulse as the pulser bell reaches both the restricted and unrestricted positions, thereby increasing the pulse generating rate over conventional measurement-while-drilling (MWD) devices. Most conventional devices only generate a signal pulse in a single direction. The present invention allows for several pulser bell assemblies (FIG. 1) to be placed in a drilling collar, thereby generating an exponential increase in the number of signals, further defining geological information that allows for improved oil field drilling efficiency.

Positioning of the pulser assembly (FIG. 1) within the drill collar [29] and utilizing the flow guide [30] significantly decreases the turbulence of the fluid. The fluid flow force required to move the poppet assembly into or out of the poppet seat is a nominal 3.5+/− pounds. Operational power consumption to retain the poppet in most positions is estimated to be 200 mA+/−. The linear motion of the pulser bell [17] axially along the pulser guide pole [28] is both up and down (along a bi-axial direction).

Conventional pulsers require adjustments to provide a consistent pulse at different fluid pump and down hole pressure and flow rates. The signal provided in the conventional technology is by a pulse that can be received up hole by use of a pressure transducer that is able to differentiate pressure pulses (generated downhole). These uphole pulses are then converted into useful signals providing information for the oilfield operator, such as gamma ray counts per second, azimuth, etc. Another advantage of the present invention is the ability to create a clean (essentially free of noise) pulse signal independent of the fluid flow rate or pressure within the drill collar. The present invention thereby allows for pulses of varying amplitudes (in pressure) that can be transmitted uphole with data bit rates that can be substantially increased to greater than 6 bits/sec by use of additional pulser assemblies and varying the restriction caused by the movement of the pulser bell. Addition of more than one purser assembly would lead to an exponential increase in the data bit rate received uphole.

The connecting flow channels allow for equalization or at least achievement of near or complete equilibrium of the pressure across the poppet. The primary pressure change occurs between the inner middle and inner lower flow channels providing a pressure drop created by the pulser bell restricting the annular flow through the throttle zone. This minimal pressure drop across the poppet is the only force per unit area that must be overcome to engage or disengage the poppet from the seated position and effect a pulse. This minimal pressure drop across a minimal cross-sectional area of the poppet ensures that only a small force is required to provide a pulse.

While the present invention has been described herein with reference to a specific exemplary embodiment thereof, it will be evident that various modifications and changes may be made thereto without departing from the broader spirit and scope of the invention as set forth in the appended claims. The specification and drawing included herein are, accordingly to be regarded in an illustrative rather than in a restrictive sense.

DETAILED DESCRIPTION OF THE DRAWINGS

Figure 1A:
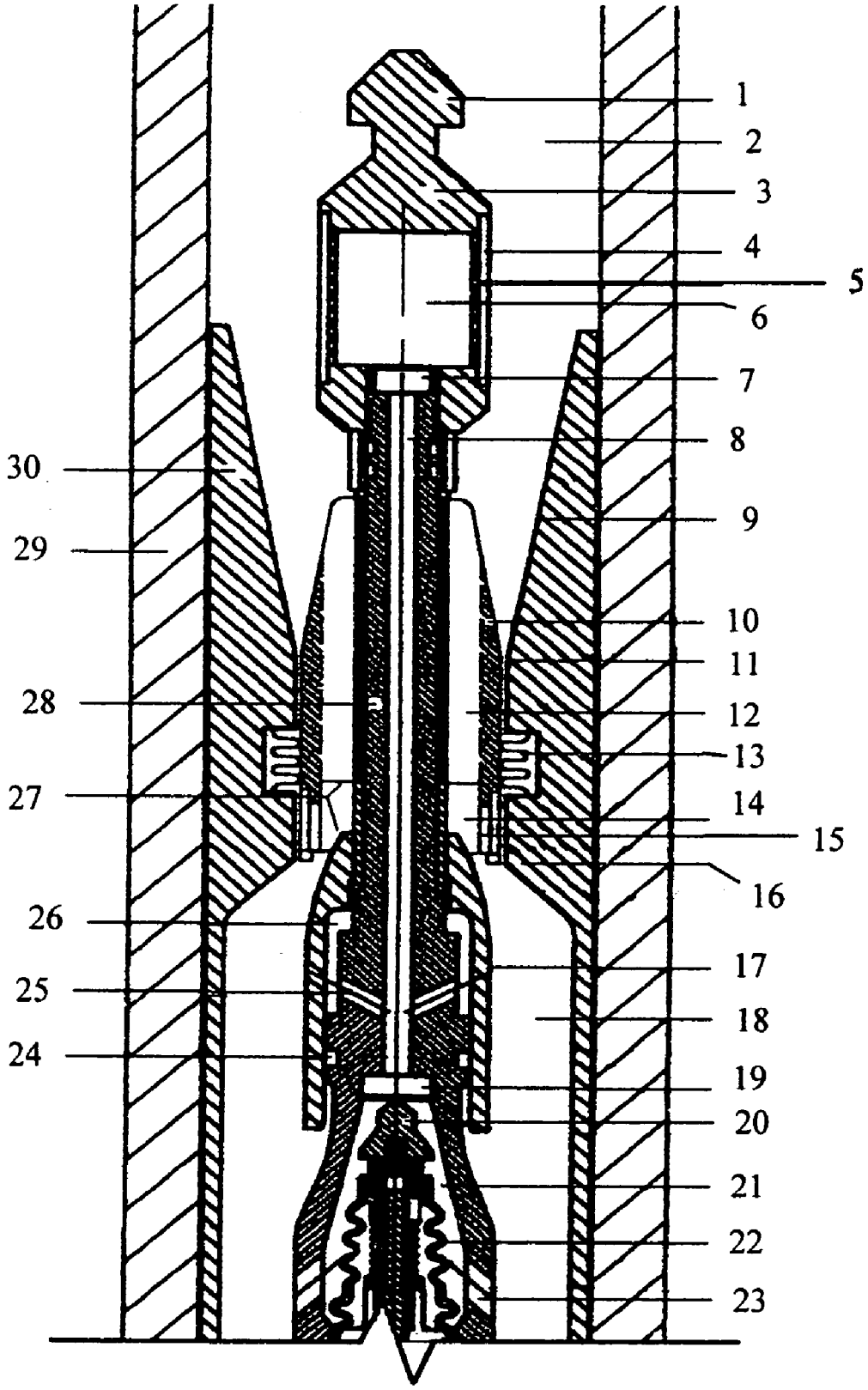
FIG. 1A is a cut-away longitudinal sectional view of the pulser bell and associated apparatus of the present invention and references many of the critical features of the invention.
Figure 1B:
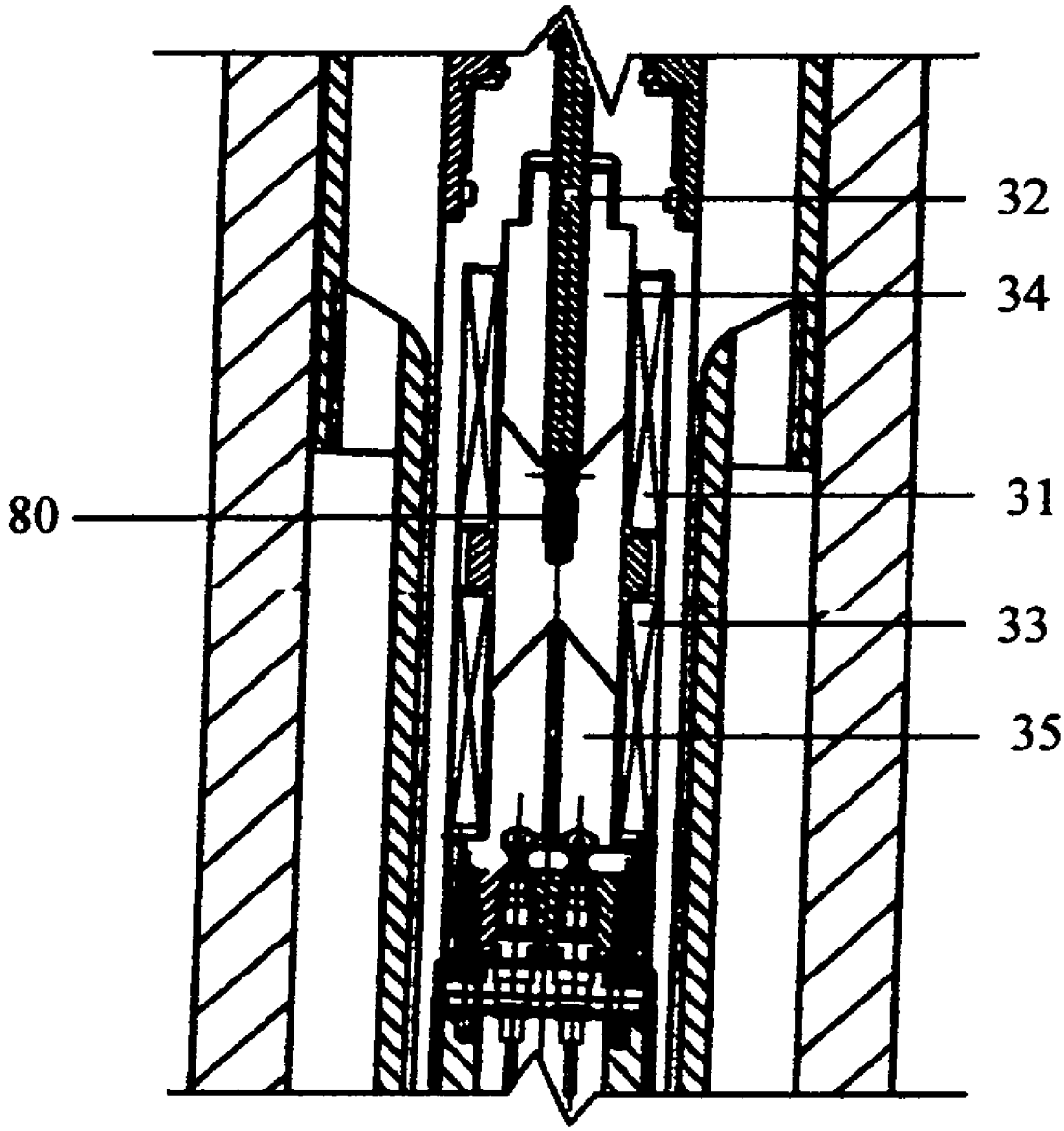
FIG. 1B is a continuation of the cross-sectional view shown in FIG. 1A and includes features that exist in an area below the pulser bell and associated apparatus including information regarding the solenoid actuation system and related components.

The present invention will now be described in greater detail referring specifically to the accompanying drawings. With reference to FIGS. 1A, 1B and IC, as well as FIG. 2, the MWD device. For FIG. 1A, there exists a tubular drill collar [29] and upper annular drill collar flow channel [2]. A flow guide [30] is secured to the inner diameter of the drill collar [29]. The centralizer (shown in FIG. 1C) [36] secures the lower portion of the pulse generating device and is comprised of a non-magnetic, rigid, high temperature, wear resistant material with outer flow channels.

A poppet assembly [20] restricts and permits drill fluid flow through a poppet seat [19]. As shown in FIG. 1B, a rear solenoid [31] actuates the right flux concentrator [33] the solenoid actuator shaft [35] and poppet assembly [20]. Referring back to FIG. 1A. a fishing head [1] and mud screen assembly [3] contain radially aligned slots [4] a helical fluid screen [5] and a fluid screen assembly interior flow reservoir [6]. Fluid within the fluid screen assembly interior flow reservoir [6] flows into the transition between the fluid screen reservoir and inner flow channel [7] and the middle inner flow channel [8] within the pulser guide pole [28].

Fluid flows past the upper inner flow connecting channels [25] sliding pressure chamber [26] and into the poppet seat [19] allowing the poppet assembly [20] to remain below the poppet seat [19], thereby allowing the fluid to flow into the lower inner flow channel [21], past the poppet bellows [22] and out of the lower inner flow connecting channels [23] into the lower annular drill collar flow channel [18]. Additionally the material flows from the sliding pressure chamber [26] through the upper inner flow connecting channels [25] and past the poppet assembly [20] allowing the pulser bell [17] to move downward along the pulser guide pole [28] out of the throttle zone for pulse generation [14].

A rear solenoid [31] and front solenoid [34] is energized causing the left flux concentrator [32] and solenoid actuator shaft [35] to push the poppet assembly [20] to seal against the poppet seat [19].

Figure 1C:
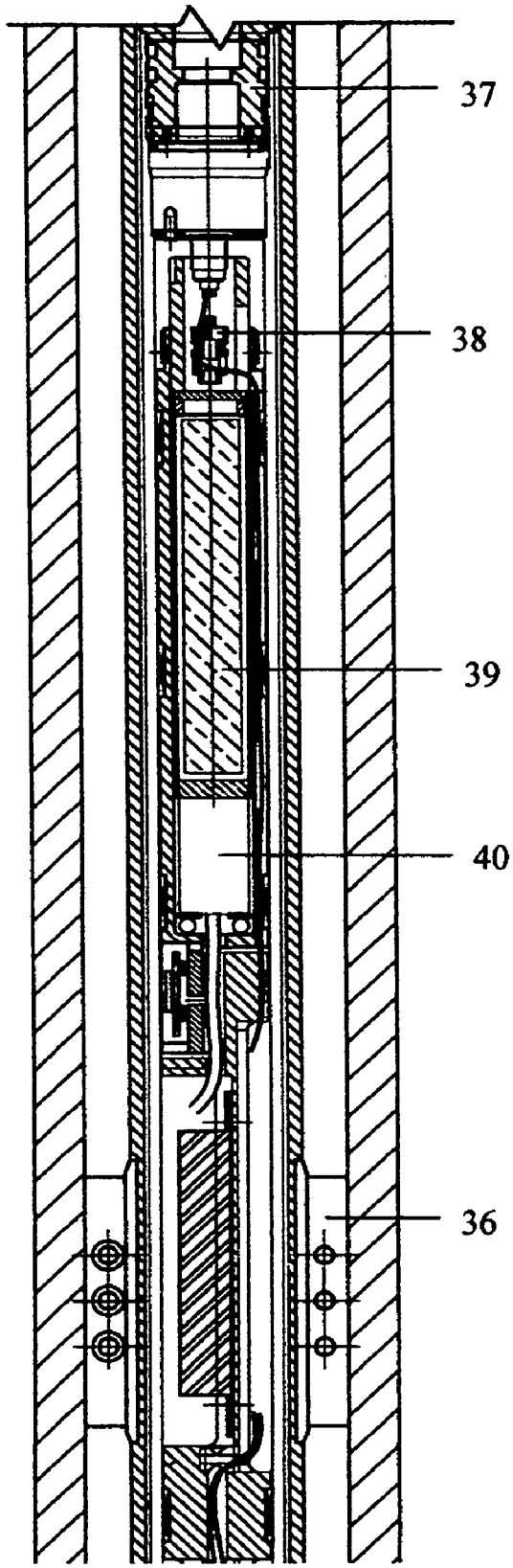
FIG. 1C is a further continuation of FIG. 1B, illustrating additional components used in measurement-while-drilling tools as well as the rigid centralizer required for the system of the present invention.
Figure 2:
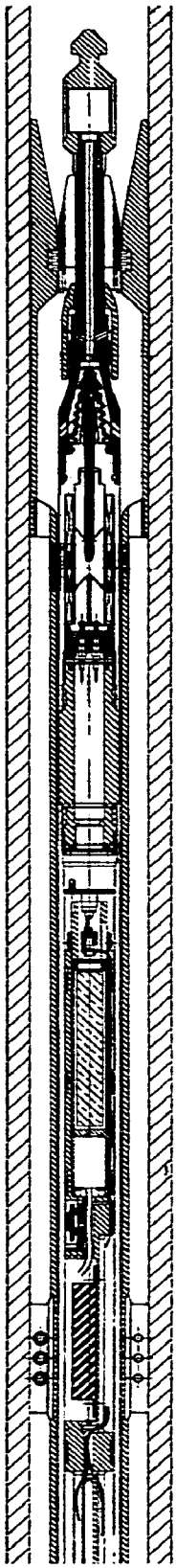
FIG. 2 is the compilation of FIGS. 1A, 1B and 1C.

FIG. 2 is a compilation of FIGS. 1A, 1B and 1C and is provided so that a full detailed view of the subject of the invention is understood. The complete device and system is featured in FIG. 2 a system.

What is claimed is:

1. An apparatus for generating pressure pulses in a drilling fluid, flowing within a drill string, comprising:

a pulse generating device longitudinally positioned within an annular drill collar flow channel such that said drilling fluid flows through said annular drill collar flow channel and said drilling fluid is guided into two sets of selectively reversible flow, upper and lower flow connecting channels, wherein said connecting channels are connected to an inner flow channel and said annular drill collar flow channel, and wherein said annular drill collar flow channel is specifically designed for steady, laminar-like flow, such that a reproducible pulse is generated by a pulser bell, thereby transmitting signals.

2. The apparatus of claim 1, wherein said apparatus for generating pulses includes a poppet, a poppet bellows, a pulser bell, a sliding pressure chamber, and a pulser guide pole, wherein said upper and lower flow connecting channels provide for reversal of flow wherein said poppet seals a middle inner flow channel from said lower inner flow channel and such that said pulser bell and said poppet are capable of bi-directional axial movement along said guide pole.

3. The apparatus of claim 1, wherein said apparatus for generating pulses includes at least one solenoid and a pulser guide pole capable of providing a path for said poppet and said pulser bell for operation in a bi-directional axial movement.

4. The apparatus of claim 3, wherein said apparatus for generating pulses includes two or more solenoids that are selectively engaged via an electrical signal generated by an electrical source and a programmable controller.

5. The apparatus of claim 1, wherein said apparatus for generating pulses includes said upper flow connecting channel having an inlet opening located at an upstream end above said poppet and said lower flow connecting channel having an outlet opening at a downstream end below said poppet and a poppet bellows, and wherein said apparatus also embodies a sliding pressure chamber formed between said pulser bell and said pulser guide pole wherein said sliding pressure chamber is connected by one set of connecting channels to said middle inner flow channel wherein said pulser bell is capable of bi-directional axial movement along said pulser guide pole, and wherein said one set of upper connecting flow channels is directed in an upward direction as related to said fluid flow and one set of lower connecting channels that are directed in a downward or same direction as said fluid flow such that said lower connecting channels are angled to readily evacuate said flow toward a downward end of said lower annular flow channel.

6. The apparatus of claim 1, wherein said lower inner flow connecting channels allow for a shift toward pressure equilibrium wherein said lower inner flow channel comprises a relative pressure that is lower than a relative pressure within said middle inner flow channel.

7. The apparatus of claim 6, wherein a pressure that must be overcome to engage or disengage said poppet from a sealed position is a differential pressure across a throttle zone, said zone defined as being between said lower inner flow channel and said middle inner flow channel.

8. The apparatus of claim 7, wherein said differential pressure is minimal in that slight force acting on a small cross-sectional area of a poppet seat defines said minimal pressure that is required to either engage or disengage said poppet.

9. The apparatus of claim 7, wherein upper, middle, and lower annular drill collar flow channels provide flow restriction features to reduce drilling fluid turbulence within said annular flow channels.

10. The apparatus of claim 7, wherein said pulser bell moves in either an upward or downward direction for restricting or unrestricting said middle annular drill collar flow channel during pulse generation.

11. The apparatus of claim 10, wherein said pulse generating apparatus includes a coupling means for extrication from said drill collar.

12. A method for generating pressure pulses in a drilling fluid flowing downward within a drill string, comprising:

at an initial first position, activating a first bottom solenoid such that a poppet within a lower inner flow channel is not initially sealed and holding said poppet in said position with a minimal current;

at a second position, providing for deactivating said first bottom solenoid and activating a second top solenoid, thereby moving said poppet into a sealed position, sealing a lower inner flow channel from a middle inner flow channel and forcing an inner fluid into a pair of upper connecting flow channels causing a pulser bell to move up toward a portion of a middle annular flow channel, and stopping short of seating thereby causing a flow restriction as well as a positive pressure pulse, while simultaneously fluid is entering a set of lower inner connecting flow channels reducing a pressure drop across a poppet seat requiring minimal force be used for holding said poppet in a sealed position;

moving said poppet back to an initial first position while allowing said inner fluid through said poppet seat to flow toward said set of lower connecting flow channels connecting to said lower inner flow channel that is allowing said pulser bell to move in a same direction as said drilling fluid, thereby resulting in decreasing pressure within a sliding pressure chamber as fluid is flowing out of a set of upper flow connecting channels and constricting said pressure chamber, and unrestricting flow from a middle annular drill collar flow channel to a lower annular drill collar flow channel providing a negative pressure pulse, wherein said pulser bell is moving in a downward direction along a same direction as said flowing drilling fluid until said pulser bell is motionless.

13. The method of claim 12, wherein said flow restriction is causing a pressure differential resulting in a pulse detected uphole.

14. The method as described in claim 12, wherein said pulses possess little or no noise in a signal-to-noise ratio and wherein said pulses are extremely reproducible.

15. The method as described in claim 14, wherein creating said pulses occurs with a minimum amount of electrical energy such that operating said solenoids for extended lengths of time is achievable.

16. A measurement-while-drilling device in a drilling fluid, flowing within a drill string, comprising:

a device for making measurements while drilling coupled to a pulse generating device longitudinally positioned within an annular drill collar flow channel such that said drilling fluid flows through said annular drill collar flow channel and said drilling fluid is guided into two sets of selectively reversible flow, upper and lower flow connecting channels, wherein said connecting channels are connected to an inner flow channel and said annular drill collar flow channel, and wherein said annular drill collar flow channel is specifically designed for steady, laminar-like flow, such that a reproducible pulse is generated by a pulser bell, thereby transmitting signals.

17. The device of claim 16, wherein said device for measurement-while-drilling for generating pulses includes; a poppet, a poppet bellows, a pulser bell, a sliding pressure chamber, and a pulser guide pole, wherein said upper and lower flow connecting channels provide for reversal of flow wherein said poppet seals a middle inner flow channel from said lower inner flow channel and such that said pulser bell and said poppet are capable of bi-directional axial movement along said guide pole.

18. The device of claim 16, wherein said device for measurement-while-drilling includes at least one solenoid and a pulser guide pole capable of providing a path for said poppet and said pulser bell for operation in a bi-directional axial movement.

19. The device of claim 16, wherein said device for measurement-while-drilling includes two or more solenoids that are selectively engaged via an electrical signal generated by an electrical source and a programmable controller.

20. The device of claim 16, wherein said device includes said upper flow connecting channel having an inlet opening located at an upstream end above said poppet and said lower flow connecting channel having an outlet opening at a downstream end below said poppet and a poppet bellows, and wherein said apparatus also embodies a sliding pressure chamber formed between said pulser bell and said pulser guide pole wherein said sliding pressure chamber is connected by one set of connecting channels to said middle inner flow channel wherein said pulser bell is capable of bi-directional axial movement along said pulser guide pole, and wherein said one set of upper connecting flow channels is directed in an upward direction as related to said fluid flow and one set of lower connecting channels that are directed in a downward or same direction as said fluid flow such that said lower connecting channels are angled to readily evacuate said flow toward a downward end of said lower annular flow channel.

21. The device of claim 20, wherein said lower inner flow connecting channels allow for a shift toward pressure equilibrium wherein said lower inner flow channel comprises a relative pressure that is lower than a relative pressure within said middle inner flow channel.

22. The device of claim 21, wherein a pressure that must be overcome to engage or disengage said poppet from a sealed position is a differential pressure across a throttle zone, said zone defined as being between said lower inner flow channel and said middle inner flow channel.

23. The device of claim 22, wherein said differential pressure is minimal in that a slight force acting on a small cross-sectional area of a poppet seat defines said minimal pressure that is required to either engage or disengage said poppet.

24. The device of claim 23, wherein upper, middle, and lower annular drill collar flow channels provide flow restriction features to reduce said drilling fluid turbulence within said annular flow channel.

25. The device of claim 20, wherein said pulser bell moves in either an upward or downward direction for restricting or unrestricting said middle annular drill collar flow channel during pulse generation.

26. Two or more apparatuses for generating pressure pulses in a drilling fluid, flowing within a drill string, comprising:

a first and a second apparatus for generating pressure pulses within a drill string wherein each apparatus includes:

a pulse generating device longitudinally positioned within an annular drill collar flow channel such that said drilling fluid flows through said annular drill collar flow channel and said drilling fluid is guided into two sets of selectively reversible flow, upper and lower flow connecting channels, wherein said connecting channels are connected to an inner flow channel and said annular drill collar flow channel, and wherein said annular drill collar flow channel is specifically designed for steady, laminar-like flow, such that a reproducible pulse is generated by a pulser bell, thereby transmitting signals.

27. A method for generating pressure pulses in a drilling fluid flowing downward within a drill string of a measurement-while-drilling device, comprising:

receiving signals from a device for making measurements while drilling; and generating pulses in response to the device for making measurements by:

at an initial first position, activating a first bottom solenoid such that a poppet within a lower inner flow channel is not initially sealed and holding said poppet in said position with a minimal current;

at a second position, providing for deactivating said first bottom solenoid and activating a second top solenoid, thereby moving said poppet into a sealed position, sealing a lower inner flow channel from a middle inner flow channel and forcing an inner fluid into a pair of upper connecting flow channels causing a pulser bell to move up toward a portion of a middle annular flow channel, and stopping short of seating thereby causing a flow restriction as well as a positive pressure pulse, while simultaneously fluid is entering a set of lower inner connecting flow channels reducing a pressure drop across a poppet seat requiring minimal force be used for holding said poppet in a sealed position;

moving said poppet back to an initial first position while allowing said inner fluid through said poppet seat to flow toward said set of lower connecting flow channels connecting to said lower inner flow channel that is allowing said pulser bell to move in a same direction as said drilling fluid thereby resulting in evacuation of a sliding pressure chamber wherein fluid is flowing out of a set of upper flow connecting channels and constricting said pressure chamber, and unrestricting flow from a middle annular drill collar flow channel to a lower annular drill collar flow channel providing a negative pressure pulse, wherein said pulser bell is moving in a downward direction along a same direction as said flowing drilling fluid until said pulser bell is motionless.

28. The method as described in claim 27, wherein said flow restriction is causing a pressure differential resulting in a pulse detected uphole.

29. The method as described in claim 27, wherein said pulses possess little or no noise in a signal-to-noise ratio and wherein said pulses are extremely reproducible.

30. The method as described in claim 27, wherein creating said pulses occurs with a minimum amount of electrical energy such that operating said solenoids for extended lengths of time is achievable.

31. A pulse generating system for generating pressure pulses in a drilling fluid comprising;

a pulse generating device longitudinally positioned within an annular drill collar flow channel such that said drilling fluid flows though said annular drill collar flow channel and said drilling fluid is guided into two sets of selectively reversible flow, upper and lower flow connecting channels, wherein said connecting channels are connected to an inner flow channel and said annular drill collar flow channel, and wherein said annular drill collar flow channel is specifically designed for steady, laminar-like flow, such that a reproducible pulse is generated by a pulser bell, thereby transmitting signals and wherein said pulse generating device operatates by:

at an initial first position, activating a first bottom solenoid such that a poppet within a lower inner flow channel is not initially sealed and holding said poppet in said position with a minimal current;

at a second position, providing for deactivating said first bottom solenoid and activating a second top solenoid, thereby moving said poppet into a sealed position, sealing a lower inner flow channel from a middle inner flow channel and forcing an inner fluid into a pair of upper connecting flow channels causing a pulser bell to move up toward a portion of a middle annular flow channel, and stopping short of seating thereby causing a flow restriction as well as a positive pressure pulse, while simultaneously fluid is entering a set of lower inner connecting flow channels reducing a pressure drop across a poppet seat requiring minimal force be used for holding said poppet in a sealed position;

moving said poppet back to an initial first position while allowing said inner fluid through said poppet seat to flow toward said set of lower connecting flow channels connecting to said lower inner flow channel that is allowing said pulser bell to move in a same direction as said drilling fluid, resulting in evacuation of a sliding pressure chamber wherein fluid is flowing out of a set of upper flow connecting channels and constricting said pressure chamber, and unrestricting flow from a middle annular drill collar flow channel to a lower annular drill collar flow channel providing a negative pressure pulse, wherein said pulser bell is moving in a downward direction along a same direction as said flowing drilling fluid until said pulser bell is motionless.

32. The system of claim 31, wherein said system for generating pulses includes a poppet, a poppet bellows, a pulser bell, a sliding pressure chamber, and a pulser guide pole, wherein said upper and lower flow connecting channels provide for reversal of flow wherein said poppet seals a middle inner flow channel from said lower inner flow channel and such that said pulser bell and said poppet are capable of bi-directional axial movement along said guide pole.

33. The system of claim 31, wherein said system for generating pulses includes at least one solenoid and a pulser guide pole capable of providing a path for said poppet and said pulser bell for operation in a bi-directional axial movement.

34. The system of claim 32, wherein said system for generating pulses includes two or more solenoids that are selectively engaged via an electrical signal generated by an electrical source and a programmable controller.

35. The system of claim 31, wherein said system for generating pulses includes said upper flow connecting channel having an inlet opening located at an upstream end above said poppet and said lower flow connecting channel having an outlet opening at a downstream end below said poppet and a poppet bellows, and wherein said system also embodies a sliding pressure chamber formed between said pulser bell and said pulser guide pole wherein said sliding pressure chamber is connected by one set of connecting channels to said middle inner flow channel wherein said pulser bell is capable of bi-directional axial movement along said pulser guide pole, and wherein said one set of upper connecting flow channels is directed in an upward direction as related to said fluid flow and one set of lower connecting channels that are directed in a downward or same direction as said fluid flow such that said lower connecting channels are angled to readily evacuate said fluid toward a downward end of said lower annular flow channel.

36. The system of claim 35, wherein said lower inner flow connecting channels allow for a shift toward pressure equilibrium wherein said lower inner flow channel comprises a relative pressure that is lower than a relative pressure within said middle inner flow channel.

37. The system of claim 36, wherein said system for generating pulses includes a pressure that must be overcome to engage or disengage said poppet from a sealed position is a differential pressure across a throttle zone, said zone defined as being between said lower inner flow channel and said middle inner flow channel.

38. The system of claim 37, wherein said differential pressure is minimal in that a slight force acting on a small cross-sectional area of a poppet seat defines said minimal pressure that is required to either engage or disengage said poppet.

39. The system of claim 38, wherein upper, middle, and lower annular drill collar flow channels provide flow restriction features to reduce drilling fluid turbulence within said annular flow channels.

40. The system of claim 39, wherein said pulser bell moves in either an upward or downward direction for restricting or unrestricting said middle annular drill collar flow channel during pulse generation.

41. The system of claim 31, wherein said pulse generating device includes a coupling means for extraction from said drill collar.

42. The system of claim 31, wherein said pulse generating device is located within a non-turbulent drilling fluid flow.

43. The system of claim 31, wherein a pressure that must be overcome to engage or disengage said poppet from a sealed position is a differential pressure across a throttle zone defined as being between said lower inner flow channel and said middle inner flow channel.

44. The system of claim 31, wherein said differential pressure between said lower and middle annular drill collar flow channels is the same as said differential pressure between said lower inner and middle inner flow channels when said poppet is in a sealed position.

45. The system of claim 31, wherein actuation of said solenoids requires variable current linearly proportional to a change in pressure between said lower inner and said middle inner flow channels.

* * * * *